United States Patent [19]

Kato et al.

[11] Patent Number: 4,502,984

[45] Date of Patent: Mar. 5, 1985

[54] ELECTROCONDUCTIVE BASE SHEET FOR ELECTROSTATIC RECORDING

[75] Inventors: Eiichi Kato; Masataka Okamoto; Hiroshi Ueda; Masaharu Inaba, all of Tokyo, Japan

[73] Assignee: Jujo Paper Co., Ltd., Tokyo, Japan

[21] Appl. No.: 541,568

[22] Filed: Oct. 13, 1983

[30] Foreign Application Priority Data

Oct. 14, 1982 [JP] Japan ..... 57-179154
Nov. 4, 1982 [JP] Japan ..... 57-192382

[51] Int. Cl.[3] ..... H01B 1/06

[52] U.S. Cl. ..... 252/518; 252/520; 428/532; 428/702

[58] Field of Search ..... 252/518, 510, 517, 520; 428/328, 702, 532; 346/153.1, 155

[56] References Cited

U.S. PATENT DOCUMENTS 4,160,748 7/1979 Yodogawa et al. ..... 252/518
4,293,839 10/1981 Asada et al. ..... 252/518

*Primary Examiner*—Josephine L. Barr
*Attorney, Agent, or Firm*—Koda and Androlia

[57] ABSTRACT

Electroconductive base sheet for electrostatic according which comprises an electroconductive layer containing both a metal oxide semiconductor of this invention and at least one substance selected from the group consisting of a reducing saccharide, a derivative thereof, ascorbic acid, an optical isomer of ascorbic acid and a reducing ascorbic acid derivative of this invention. The electroconductive base sheet provides a superior electroconductivity.

9 Claims, No Drawings

ELECTROCONDUCTIVE BASE SHEET FOR ELECTROSTATIC RECORDING

BACKGROUND OF THE INVENTION

1. Field of the Invention

This invention concerns an electroconductive base sheet for electrostatic recording for use with electrostatic recording sheets or electrophotographic recording sheets.

2. Prior Art

In electrostatic recording or electrophotographic recording, characters or figures are once transformed by way of electric or optical signals into electrostatic latent images and then visualized for recording. Generally, recording base sheets used for these recording systems are treated for lowering the electrical resistivity. Electroconductive material employed for such treatment include ionic type such as inorganic salts and polymeric electrolytes or electron conduction type such as metal oxide semiconductors. Use of the ionic type among them, has a drawback in that the resistivity of the electronconductive layer is influenced by the humidity since the ion conductivity thereof responds to the moisture content. Accordingly, it is generally considered advantageous to use metal oxide semiconductors such as tin dioxide, indium oxide and zinc oxide which are less sensitive to the humidity. Particularly, in view of the cost zinc oxide is most advantageous. However, the electroconductive zinc oxide has a drawback in that a desired surface resistivity can not usually be obtained unless it is coated in a great amount. For example, it needs about 12–15 g/m$^2$ of the coating weight to obtain about $10^7\Omega$ of the resistivity of the electroconductive layer for an electrostatic recording. In view of the above, it has been attempted to decrease the coating weight of a relatively expensive electroconductive zinc oxide to reduce the material cost and save the heat energy for the drying process.

SUMMARY OF THE INVENTION

It is the general object of the present invention to provide an electroconductive base sheet for electrostatic recording which has improved electroconductivity. The above-mentioned object can be performed by using the base sheet comprising an electroconductive layer containing both a metal oxide semiconductor of this invention and at least one substance selected from a group consisting of a reducing saccharide, a derivative thereof, ascorbic acid, an optical isomer of ascorbic acid and a reducing ascorbic acid derivative of this invention.

DETAILED DESCRIPTION OF THE INVENTION

Referring, for instance, to the electroconductive zinc oxide, it is an N type semiconductor prepared by adding a small amount of metal ions of III or higher valency such as aluminum, gallium, indium and tin as an impurity to zinc oxide in order to increase the electroconductivity, and the electroconductivity can be controlled by properly selecting various conditions for the production such as pre-treatment conditions, type and amount of additives, treating method, temperature and time for baking and cooling time. Actually present zinc oxide crystals have no ideal regular 3-dimensional structure but involve various imperfections, which attributable to the development of the semiconductive properties of the crystals.

The semiconductive properties of the metal oxide semiconductors including the electroconductive zinc oxide as mentioned above have a close relationship with adsorption property of gas molecules and catalytic activity and absorption of oxygen particularly lowers the electroconductivity.

The feature of this invention is to improve the electroconductivity of metal oxide semiconductors by the incorporation of at least one substance selected from the group consisting of a reducing saccharides, the derivatives thereof, ascorbic acid, an optical isomer of ascorbic acid and a reducing ascorbic acid derivative of this invention (herein after referred to as "substance of this invention"). It is considered that the substance of this invention improve the electroconductivity, propably because the substance of this invention reduce oxygen absorbed on the surface of the metal oxide semiconductor of this invention and, simultaneously, cause charge transfer between the metal oxide semiconductor and the adsorbed substance of this invention due to the adsorption including the reaction with the activated sites on the surface to thereby increase the electroconductivity.

The metal oxide semiconductors to be used in this invention, include, for example, zinc oxide, tin oxide, cadmium oxide titanium oxide, aluminum oxide, indium trioxide and thorium dioxide, and the electroconductivity of these materials generally controlled by the control of the atomic valency. While the electroconductive zinc oxide is most widely employed among them, the finer the particles are, the more it becomes effective to improvement of the electroconductivity because of the excellent contact between each particle in the electroconductive layer. Therefore, particle diameter of less than 1$\mu$ and particularly of less than 0.5$\mu$ are preferred.

Electroconductive zinc oxide prepared by cold water extraction at pH of 8.0–10.0 and, particularly, 9.0–10.0 is extremely effective. This may be attributable to the presence of alkali metals such as sodium, potassium and calcium or alkaline earth metals which are pH increasing components. Further, those containing ammonia or an ammonium complex as the impurity are desirable.

In this invention, reducing saccharides or derivatives thereof for increasing the electroconductivity of the metal oxide semiconductors as mentioned above include for example, reducing disaccharides such as maltose, lactose and melibiose; aldose type saccharides such as xylose, galactose, arabinose and mannose, ketose type saccharides such as fructose and sorbose; 2-ketoaldonic acid type saccharides such as 2-ketogluconic acid; and uronic acid type saccharides such as glucuronic acid. Aldose type, ketose type and uronic acid type saccharides have particularly intense reducing nature and provide remarkable effect for the improvement in the electroconductivity.

The ascorbic acid in this invention is a highly reducing substance having enediol groups represented by the L-ascorbic acid (I) and, together with erythrobic acid (II) as optical isomer, can improve the electroconductivity of the metal oxide semiconductors of this invention as mentioned above. In the same manner, reducing ascorbic acid derivatives of this invention are mainly those of reaction derivatives at 1,4,5,6-positions on (I) and they include, for example, ether derivatives such as 5-o-methylascorbic acid, ester derivatives such as phosphate, for example, ascorbic acid-6-phosphate and sulphate such as ascorbic acid-5-sulfate and organic acid esters such as 6-o-acetyl ascorbic acid. In addition, those materials containing enediol groups (III) are also included such as scorbamic acid as amine derivatives, amidine derivatives, sodium ascorbate as metal salt or basic salt.

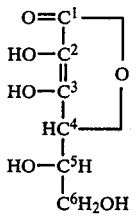

L-ascorbic acid (I)

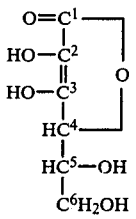

erythrobic acid (II)

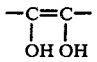

enediol group (III)

Furthermore, those derivatives in which one or two oxy groups in the enediol groups (III) are substituted with amino, thiol, or imino group possess the scorbamic reducing property and are also effective. For the acid as an optical isomer of the ascorbic acid, similar derivatives to those described above have the same effects and are useful to this invention.

The mixing ratio of said substance of this invention based on 100 parts by weight of the metal oxide semiconductor of this invention is less than 10 parts by weight and, preferably, between about 0.005–2.0 parts by weight as the solid content. The reaction between said substance of this invention and the metal oxide semiconductor of this invention take place rapidly and the change of the resistivity after the formation of the electroconductive layer by way of the coating is scarcely recognized. Said substance of this invention and the metal oxide semiconductor of this invention are usually mixed upon preparation of coating color but, in some cases, said substance of this invention may be adsorbed substantially on the surface of the metal oxide semiconductor of this invention by previously mixing both of them as a pre-treatment and the thus surface treated metal oxide semiconductor can be used.

Binders preferably used herein include, for example, those water soluble high molecular binders such as polyvinyl alcohol, hydroxyethylcellulose, methylcellulose, carboxymethylcellulose, starch and its derivatives, styrene—maleic acid copolymer, isobutylene—maleic anhydride copolymer and gum arabic, as well as emulsion type binders such as vinylacetate—acrylic emulsion, acrylic emulsion, vinyl acetate emulsion and styrene—butadiene latex. Binders of organic solvent type may also be used.

The mixing ratio of the binder is an important factor for determining the resistivity of the electroconductive layer. If the binder is used in excess, it hinders contact between each particle of the metal oxide semiconductor powder to increase the resistivity of the electroconductive layer. Accordingly, it is preferred to use the binder, based on 100 parts by weight of metal oxide semiconductor of this invention, by about 5–30 parts by weight while taking the balance between the bonding force and the resistivity into consideration.

The electroconductive coating color usually comprises, as mentioned above, a metal oxide semiconductor of this invention, a reducing saccharide or the derivative thereof according to this invention and a binder. Furthermore, various additives may properly be added in such a range as not to impair the advantageous effects of this invention, for example, cationic type polymeric electrolytes such as polyvinylbenzyl trimethylammonium chloride, poly-N, N-dimethylmethylene piperidinium chloride, anionic type polymeric electrolytes, for example, sodium polystyrene sulfonate and sodium polyacrylate; inorganic salts such as sodium chloride, potassium chloride and lithium chloride; dispersing agents, defoaming agents, UV absorbers, complementary dyes and fluorescent dyes.

The coating color thus obtained is coated, at least on one surface of a base sheet to prepare an electroconductive layer. Generally, the coating weight is adjusted so that the surface resistivity of the electroconductive layer is about $10^6$–$10^8\Omega$ at normal temperature and humidity. Usually, it is coated or impregnated in a range of 2–20 g/m$^2$ and, preferably, 3–10 g/m$^2$ in a dry weight.

There are no particular restrictions for the materials of the substrate, and they may include, for example, fine paper and wood contained paper, synthetic paper, coated paper, cloth and films. The coating color can be coated onto the base sheet by way one of known methods such as bar coating, air knife coating, roll coating, blade coating and size pressing.

In the electroconductive substrate according to this invention, since said substance of this invention is added to a metal oxide semiconductor of this invention, a smaller amount of coating is enough for obtaining a certain surface resistivity or the mixing ratio of the metal oxide semiconductor of this invention can be decreased, which enables to lower the cost of materials sharply, and has a great effect on saving energy of coating and drying process. Furthermore, with respect to the electroconductive zinc oxide, since the dispersibility is improved by the addition of the reducing saccharide or the derivative thereof according to this invention, the coating adaptability can also be improved.

This invention will now be described referring to examples, in which "parts" mean "parts by weight".

COMPARATIVE EXAMPLE 1

100 parts of electroconductive zinc oxide with a specific resistivity of $4.0\times10^2\Omega$-cm (under a pressure of 70 kg/cm$^2$) extracted with cold water at pH 9.6 (manufactured by HAKUSUI CHEMICAL INDUSTRIES, LTD.) and 400 parts of 2.5% methylcellulose solution were previously mixed to each other and dispersed for 40 min in an attritor to prepare color A. The color A had a high viscosity and the color dispersibility was not so satisfactory. In view of the above, 0.5 parts of sodium hexamethaphosphate were further added and dispersed in another 20 min in the attritor to prepare color B. Each of the color A and B was applied on coated paper each in the coating amount of 6 g/m$^2$ and 11 g/m$^2$ after drying by using a wire bar to obtain electroconductive base sheets. These electroconductive base sheets were settled in an atmosphere at 20° C. and 50% RH for 24 hours and, thereafter, the surface resistivity of the electroconductive layers were measured.

EXAMPLE 1

100 parts of the same electroconductive zinc oxide as in Comparative Example 1 were previously mixed with 0.1 parts of galactose powder and 400 parts of 2.5% methylcellulose solution and they were dispersed for 40 min in an attritor to prepare a color. The color had a lower viscosity as compared with the color A and showed preferred color dispersibility. The color is coated in the same manner as in Comparative Example 1 to prepare electroconductive base sheets and the surface resistivity were measured.

EXAMPLES 2–5

Electroconductive base sheets were obtained in the same manner as in Example 1 excepting the use of each powder of xylose, melibiose and glucuronic acid instead of galactose powder and surface resistivity of the electroconductive layers were meausred. All of the colors had low viscosity and were excellent in the coating adaptabiltiy.

COMPARATIVE EXAMPLE 2–3

Electroconductive base sheets were prepared in the same manner as in Example 1 excepting the use of non-reducing gluconic acid and sucrose instead of galactose powder and the surface resistivity of the layers were measured. In these colors, the viscosities tended to reduce as well.

EXAMPLE 6

100 parts of the same electroconductive zinc oxide as in Comparative Example 1 were previously mixed with 0.1 parts of ascorbic acid and 400 parts of 2.5% methylcellulose solution and they were dispersed for 40 min in an attritor to prepare a color. The color had a lower viscosity as compared with the color A and showed preferred color dispersibility. The color is coated in the same manner as in Comparative Example 1 to prepare electroconductive base sheets and the surface resistivity were measured.

EXAMPLE 7

Electroconductive base sheets were obtained in the same manner as in Example 6 excepting the use of sodium ascorbate powder acid instead of ascorbic acid and surface resistivity of the electroconductive layers were measured. All of the colors had low viscosity and were excellent in the coating adaptability. Acid and surface resistivity of the electroconductive layers were measured. All of the colors had low viscosity and were excellent in the coating adaptability.

TABLE 1

| | Saccharide or derivative added | Inherent surface resistivity of conductive layer ($\rho s$) 6 g/m$^2$ ($\Omega$) | 11 g/m$^2$ ($\Omega$) | Corresponding to $\rho s = 1.0 \times 10^7\Omega$ Coating weight (g/m$^2$) | Optical density |
|---|---|---|---|---|---|
| Comparative Example 1(A) | not added | $3.4 \times 10^7$ | $1.3 \times 10^7$ | 13.5 | 1.15 |
| Comparative Example 1(B) | " | $3.5 \times 10^7$ | $1.4 \times 10^7$ | 13.7 | 1.14 |
| Example 1 | galactose | $1.6 \times 10^7$ | $7.6 \times 10^6$ | 9.0 | 1.18 |
| Example 2 | xylose | $1.1 \times 10^7$ | $6.2 \times 10^6$ | 7.7 | 1.20 |
| Example 3 | melibiose | $2.0 \times 10^7$ | $9.7 \times 10^6$ | 10.8 | 1.16 |
| Example 4 | fructose | $9.6 \times 10^6$ | $5.8 \times 10^6$ | 7.3 | 1.12 |
| Example 5 | glucuronic acid | $1.5 \times 10^7$ | $7.4 \times 10^6$ | 8.5 | 1.14 |
| Example 6 | ascorbic acid | $9.5 \times 10^6$ | $5.6 \times 10^6$ | 7.2 | 1.16 |
| Example 7 | sodium ascorbate | $1.5 \times 10^7$ | $7.6 \times 10^6$ | 9.0 | 1.15 |

TABLE 1-continued

| | Saccharide or derivative added | Inherent surface resistivity of conductive layer ($\rho s$) 6 g/m$^2$ ($\Omega$) | 11 g/m$^2$ ($\Omega$) | Corresponding to $\rho s = 1.0 \times 10^7\Omega$ Coating weight (g/m$^2$) | Optical density |
|---|---|---|---|---|---|
| Comparative Example 2 | gluconic acid | $3.8 \times 10^7$ | $1.3 \times 10^7$ | 13.4 | 1.16 |
| Comparative Example 3 | sucrose | $2.9 \times 10^7$ | $1.3 \times 10^7$ | 13.7 | 1.15 |

Note:
In comparative Examples 1(A), 1(B) use the colors A, B respectively.

The test results for the Examples 1–7 and the Comparative Examples 1–3 are shown in Table 1. In addition, the coating weight for providing $1.0\times10^7\Omega$ of inherent surface resistivity to the electroconductive layer after the humidity conditioning for 24 hours at 20° C. and 50% RH, as well as the optical density on the electrostatic recording sheet using such base sheets were also shown.

(Note 1) Coating Weight: While it is generally considered appropriate that the inherent surface resistivity of the electroconductive layer for the electrostatic recording sheet is about $1\times10^6$–$1\times10^8\Omega$, the peak for the optical density appears near $1\times10^7\Omega$. Accordingly, the coating weight required for obtaining such inherent surface resistivity was examined.

(Note 2) Optical Density: The electroconductive base sheets were subjected to super calender treatment so that the electroconductive layer had 500 sec of Beck smoothness, on which were coated a recording layer color comprising 150 parts of 20% toluene solution containing polystyrene resin and acrylic resin respectively and 60 parts of calcium carbonate in an amount of 7 g/m$^2$ (by dry weight) to prepare electrostatic recording sheets. The recording sheets were settled at 20° C. and 50% RH for 24 hours and, thereafter, recorded by an electrostatic facsimile unit (printing dot density of 8 l/mm, pin voltage −300 V, counter electrode voltage +300 V, pulse width of 12 μsec, one component type carrierless toner) and optical density was measured with a Macbeth densitometer RD-514.

COMPARATIVE EXAMPLE 4

Electroconductive base sheets were obtained in the same manner as in Comparative Example 1 excepting the use of electroconductive zinc oxide with a specific resistivity of $2.5\times10^2\Omega$-cm prepared through cold water extraction at pH 7.5 (under a pressure of 70 kg/cm$^2$) (manufactured by HAKUSUI CHEMICAL INDUSTRIES LTD.) in the color B.

EXAMPLES 8–9

Electroconductive base sheets were obtained in the same manner as in Example 1 excepting the use of the identical electroconductive zinc oxide with that in Comparative Example 4, and each 0.5 parts of xylose and gluconic acid powder as the reducing saccharides and derivatives thereof.

EXAMPLES 10–11

Electroconductive base sheets were obtained in the same manner as in Example 6 excepting the use of the identical electroconductive zinc oxide with that in Comparative Example 4, and each 0.5 parts of ascorbic acid and sodium ascorbate powder.

COMPARATIVE EXAMPLE 5

Electroconductive base sheets were obtained in the same manner as in Example 8 excepting the use of non-reducing gluconic acid instead of the xylose powder.

Test results for Examples 8–11 and Comparative Examples 4–5 are shown in Table 2.

TABLE 2

| | Saccharide or derivative added | Inherent surface resistivity of conductive layer (ρs) 6 g/m² (Ω) | 11 g/m² (Ω) | Corresponding to ρs = 1.0 × 10⁷Ω Coating weight (g/m²) | Optical density |
|---|---|---|---|---|---|
| Comparative Example 4 | not added | $7.0 \times 10^7$ | $2.0 \times 10^7$ | 15.0 | 1.14 |
| Example 8 | xylose | $5.0 \times 10^7$ | $1.7 \times 10^7$ | 14.3 | 1.16 |
| Example 9 | glucuronic acid | $6.2 \times 10^7$ | $1.8 \times 10^7$ | 14.6 | 1.13 |
| Example 10 | ascorbic acid | $4.8 \times 10^7$ | $1.6 \times 10^7$ | 14.2 | 1.15 |
| Example 11 | sodium ascorbate | $6.8 \times 10^7$ | $1.8 \times 10^7$ | 14.6 | 1.13 |
| Comparative Example 5 | gluconic acid | $7.0 \times 10^7$ | $2.1 \times 10^7$ | 15.2 | 1.15 |

COMPARATIVE EXAMPLE 6

Electroconductive base sheets were obtained in the same manner as in Comparative Example 1 excepting the use of electroconductive tin oxide with a specific resistivity of 85Ω-cm (at a pressure of 70 kg/cm²) (manufactured by MITSUBISHI METAL CORPORATION in the color B.)

EXAMPLE 12

Electroconductive base sheets were obtained in the same manner as in Example 1 excepting the use of the same electroconductive tin oxide as in Comparative Example 6 and using 0.5 parts of xylose powder as the reducing saccharide.

EXAMPLE 13

Electroconductive base sheets were obtained in the same manner as in Example 6 excepting the use of the same electroconductive tin oxide as in Comparative Example 6 and using 0.5 parts of ascorbic acid powder.

Test results for Examples 12–13 and Comparative Example 6 are shown in Table 3.

TABLE 3

| | Saccharide added | Inherent surface resistivity of conductive layer (ρs) 6 g/m² (Ω) | 11 g/m² (Ω) | Corresponding to ρs = 1.0 × 10⁷ Ω Coating weight (g/m²) | Optical density |
|---|---|---|---|---|---|
| Comparative Example 6 | not added | $1.9 \times 10^7$ | $6.6 \times 10^6$ | 8.6 | 1.16 |
| Example 12 | xylose | $1.4 \times 10^7$ | $4.0 \times 10^6$ | 7.1 | 1.14 |
| Example 13 | ascorbic acid | $1.3 \times 10^7$ | $3.9 \times 10^6$ | 6.9 | 1.14 |

As apparent from the test results shown in Tables 1–3, the inherent surface resistivity of the electroconductive layer can be reduced significantly by the addition of the reducing saccharides, the derivatives thereof, ascorbic acid, the optical isomer of ascorbic acid or the reducing ascorbic acid derivative. Therefore, according to this invention, a sufficient optical density can be obtained with a less coating weight for obtaining a certain inherent surface resistivity as compared with a case of using no additives. These effects could not be obtained without the substance of this invention. Furthermore, from the comparison between the test results for Examples 2–5 and Examples 8–9, or for Examples 6–7 and Examples 10–11, it can be found that the effect of this invention is particularly shown in the electroconductive zinc oxide prepared through cold water extraction at higher pH.

We claim:

1. Electroconductive base sheet for electrostatic recording, which comprises an electroconductive layer containing both a metal oxide semiconductor and at least one substance selected from the group consisting of maltose, lactose, melibiose, xylose, galactose, arabinose, mannose, fructose, sorbose, 2-ketogluconic acid, glucuronic acid, erythrobic acid, 5-0-methylascorbic acid, ascorbic acid-6-phosphate, ascorbic acid-5-sulfate, 6-0-acetyl ascorbic acid, scorbamic acid and sodium ascorbate, said metal oxide semiconductor being at least one member selected from the group consisting of zinc oxide, tin oxide, cadmium oxide, titanium oxide, aluminum oxide, indium oxide and thorium dioxide.

2. Electroconductive base sheet according to claim 1, wherein said metal oxide semiconductor is an electroconductive zinc oxide.

3. Electroconductive base sheet according to claim 2, wherein said electroconductive zinc oxide is one prepared by cold water extraction at pH-range of 8.0–10.0.

4. Electroconductive base sheet according to claim 2, wherein said electroconductive zinc oxide has particle diameter of less than 1μ.

5. Electroconductive base sheet according to claim 1, wherein the amount of said substance is less than 10 parts by weight, based on 100 parts by weight of said metal oxide semiconductor.

6. Electroconductive substrate according to claim 1, wherein said electroconductive layer comprises a binder.

7. Electroconductive base sheet according to claim 6, wherein the amount of said binder is about 5–30 parts by weight, based on 100 parts by weight of said metal oxide semiconductor.

8. Electroconductive base sheet according to claim 1, wherein the amount of said electroconductive layer is adjusted so that the surface resistivity of said electroconductive layer is about $10^6$–$10^8$Ω at normal temperature and humidity.

9. Electroconductive base sheet according to claim 1, wherein the amount of said electroconductive layer is in a range of 2–20 g/m² in a dry weight.

* * * * *